US007441859B2

(12) United States Patent
Hayasaki

(10) Patent No.: US 7,441,859 B2
(45) Date of Patent: Oct. 28, 2008

(54) ELEMENT SUBSTRATE FOR RECORDING HEAD, RECORDING HEAD, AND RECORDING APPARATUS

(75) Inventor: Kimiyuki Hayasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/302,601

(22) Filed: Dec. 14, 2005

(65) Prior Publication Data

US 2006/0139383 A1 Jun. 29, 2006

(30) Foreign Application Priority Data

Dec. 27, 2004 (JP) ..... 2004-375469

(51) Int. Cl.
*B41J 29/38* (2006.01)

(52) U.S. Cl. ..... 347/17; 347/5; 347/14

(58) Field of Classification Search ..... 347/19, 347/20, 23, 50, 67, 26, 40, 48, 54, 56, 57, 347/58, 59, 60, 61, 88, 194
See application file for complete search history.

(56) References Cited

U.S. PATENT DOCUMENTS 5,880,753 A 3/1999 Ikeda et al.
5,943,069 A * 8/1999 Kamiyama et al. ..... 347/14
6,234,599 B1 5/2001 Ishinaga et al.
6,357,863 B1 3/2002 Anderson et al.
6,382,755 B1 * 5/2002 Imanaka et al. ..... 347/12
6,450,616 B1 * 9/2002 Kubota et al. ..... 347/48
6,598,952 B2 * 7/2003 Ishinaga et al. ..... 347/14
6,616,257 B2 * 9/2003 Imanaka et al. ..... 347/10
6,672,711 B2 * 1/2004 Kao et al. ..... 347/60
6,966,629 B2 * 11/2005 Nakajima et al. ..... 347/43
7,101,006 B2 * 9/2006 Kyoshima ..... 347/10
7,163,272 B2 * 1/2007 Parish et al. ..... 347/17

* cited by examiner

*Primary Examiner*—Stephen D Meier
*Assistant Examiner*—Rene Garcia, Jr.
(74) *Attorney, Agent, or Firm*—Canon U.S.A., Inc., IP Division

(57) ABSTRACT

The structure of a recording head and a control sequence of a recording apparatus that compensate for a change in a recording element characteristic due to a temperature change of the recording head without increasing the number of terminals of the recording head are provided. Devices for individually heating and controlling a plurality of sub-heaters on an element substrate of the recording head are arranged on an element substrate of the recording head, and digital control information for controlling these devices is inputted to the element substrate.

11 Claims, 15 Drawing Sheets

FIG. 6

| PRINT DUTY (%) OF EACH SUB-HEATER REGION | TREATMENT | STATE OF EACH HEATING DEVICE | | | | | | | |
|---|---|---|---|---|---|---|---|---|---|
| | | BIT-UPDATE STATE AT LAT TIMING | | | | | | | |
| | | 1 | 2 | 3 | 4 | 5 | 6 | 7 | 8 |
| 0 | A | ○ | ○ | ○ | ○ | ○ | ○ | ○ | ○ |
| 12.5 | B | ○ | ○ | ○ | ○ | ○ | ○ | ○ | × |
| 25 | C | ○ | ○ | ○ | ○ | ○ | ○ | × | × |
| 37.5 | D | ○ | ○ | ○ | ○ | ○ | × | × | × |
| 50 | E | ○ | ○ | ○ | ○ | × | × | × | × |
| 62.5 | F | ○ | ○ | ○ | × | × | × | × | × |
| 75 | G | ○ | ○ | × | × | × | × | × | × |
| 87.5 | H | ○ | × | × | × | × | × | × | × |
| 100 | I | × | × | × | × | × | × | × | × |

-- PRIOR ART --

-- PRIOR ART --

ELEMENT SUBSTRATE FOR RECORDING HEAD, RECORDING HEAD, AND RECORDING APPARATUS

BACKGROUND OF THE INVENTION

1. Field of the Invention

The present invention relates to a recording-head element substrate, a recording head, and the control circuit configuration of a recording apparatus having the recording head mounted thereon, and more particularly, it relates to the temperature-adjusting control configuration of the recording head.

2. Description of the Related Art

As an information output apparatus of a personal computer, a facsimile machine, or the like, a variety of inkjet recording apparatuses discharging ink through discharge ports arranged so as to correspond to recording elements are known. Of these recording apparatuses, a recording apparatus heating and then discharging ink has electrothermal conversion elements generating energy for discharging ink, incorporated therein so as to serve as recording elements (electrothermal converters), thereby achieving a high-density and high-speed recording performance and being widely available as a low-price color printer or the like.

In a known inkjet recording head, a plurality of recording elements are arranged in a single row or plurality of rows. In the recording head, control wiring terminals are arranged so as to drive a single block of N pieces of recording elements at the same time, an arbitrary recording operation is performed onto a recording material (recording medium) such as a sheet of paper by energizing the recording elements during the period of making the terminals active.

By mounting several or several tens of pieces of driving integrated circuits capable of concurrently driving the recording elements in a unit of a block on the common element substrate, image information can be aligned so as to correspond to each recording element.

The performance of the recording head has drastically improved due to its development for higher definition. An increase in the recording speed of the recording head has been achieved by increasing the number of recording elements or by increasing the number of recording elements that are driven concurrently. The performance of the recording element has been also advanced, resulting in discharging an ink droplet having an amount of several pico litters ($10^{-6}$ $m^3$) on a pulse having a width of about 1 micro seconds. This performance is achieved with a functional element (such as a MOSFET driver) capable of switching large electric current at high speed. While the size of the functional element has been reduced year after year, reduction in the size of an inkjet-recording-head element substrate having multiple channels has been advanced.

In recent years, needs for the inkjet-recording-head element substrate having multiple channels have increased mainly for use in a small-sized color inkjet recording head, because a device component forming a color image at low cost is essential for the structure of a currently manufactured product. Several techniques for arranging ink channels for a plurality of colors on the common element substrate are known. For example, with a known technique, the recording elements are arranged in a single row, and the ink channels for discharging mutually different color ink are separated from each other so as to prevent a color mixture of the ink. With another known technique, a single row of the recording elements is allotted to each of a plurality of the ink channels. In addition, another technique arranging recording-element-rows on both sides of each of the plurality of ink channels has been achieved. These techniques are inevitable for achieving a high-speed and high-resolution printing operation, and reducing the sizes of these components is a development issue from now on.

A multiple of types of inkjet recording heads have been developed so as to meet the requirements of the performances of the main bodies of printers having the respective recording heads mounted thereon, and control circuits of the recording heads become complicated. In order to make high-speed and high-resolution inkjet recording heads including these circuits and having a multiple of ink channels, optimization of each control circuit needed for the recording head is an issue of the inkjet-recording-head element substrate.

In addition, controlling drive of the recording head in response to a consumed amount of a recording agent such as ink accommodated in a cartridge and the number of consumed cartridges is often required. Also, controlling the recording head according to a color and a viscosity of ink, a date of manufacture, use application, and the like is often required.

In order to meet the above-described requirements for the inkjet recording head, a known inkjet recording head has devices disposed therein, respectively for detecting its temperature and arbitrarily changing its drive method with an external signal. Also, with a proposed record-controlling method, in order to achieve a high-function, high definition, and low-cost recording apparatus, the recording head includes a device for detecting a difference in the inkjet recording heads due to its manufacturing dispersion.

In a recording apparatus including the inkjet recording head as described above, always discharging a constant amount of ink and landing it onto a recording medium are essential for achieving a higher recording speed and a higher recording density. To this end, controlling the recording elements in the recording head so as to always perform a constant discharge characteristic is needed. For example, a fall of the environmental temperature of the recording apparatus causes a fall of the temperature of ink in the recording head. Therefore, although depending on a property of ink, the recording apparatus sometimes does not perform its original discharge characteristic in the room temperature surroundings.

Hence, even at the time of a low temperature, the temperature of ink is hitherto adjusted up to around a room temperature, for example, by attaching heating devices to the inkjet recording head or building them in the element substrate of the same. Sensors or the like for detecting the temperature are also placed on the inkjet recording head. At the same time, an amount of a discharge ink becomes smaller in recent years, down to several to several tens pico litters ($10^{-6}$ $m^3$), whereby the discharge characteristic of the recording head tends to be affected by dispersion in temperatures on the inkjet-recording-head element substrate. In such a situation, in order to stably control the temperature of ink, it is necessary to carefully determine the numbers and the locations of the heating devices and the temperature sensors.

In view of these problems, U.S. Pat. No. 5,880,753 proposes a system in which a plurality of head-temperature-adjusting heating devices are arranged on the inkjet recording head so as to individually control ink droplets depending on their temperatures. In this case, the plurality of heating devices is controlled by an external recording apparatus via a plurality of exclusive terminals individually extending from the inkjet recording head. With this arrangement, the number of terminals corresponding to the numbers of the heating devices and the temperature sensors increases. Also, U.S. Pat.

No. 6,234,599 proposes the structure of the inkjet recording head, in which the heating devices, each making a pair with the corresponding one of the temperature sensors, are arranged on the inkjet-recording-head element substrate. With this arrangement, the temperature adjusting control at a position as close as possible to the corresponding temperature sensor is achieved. Unfortunately, this arrangement causes an increase in the number of terminals in the same manner as in the foregoing patent document, thereby preventing configuration of a low cost inkjet recording head because the number of terminals of the inkjet recording head increases.

U.S. Pat. No. 6,357,863 discloses the structure of the inkjet recording head, in which, by arranging a plurality of heating devices in parallel to the row of the ink discharge elements, and gradually changing the area of the heating devices from the end to the center of the element substrate, the overall inkjet recording head is uniformly heated. This is an important control from the viewpoint of raising the temperatures of the inkjet recording head and ink up to around a room temperature in a short time when a recording operation is carried out under low temperature circumstances.

With the inkjet recording head in the recent years, due to miniaturization of the droplet of ink as described above, even a fine temperature change affects a discharge characteristic of ink. Not only preheat performed prior to a recording operation by a small number, i.e., one or two, of heating elements, but also controlling the temperature of the recording elements in a unit of block are needed. Hence, while pluralities of the heating devices and the temperature sensors as disclosed in the foregoing patent documents can be arranged in a unit of block, the structure of individually controlling these devices and sensors from outside does not allow a problem of an increase in the number of terminals of the inkjet recording head to be avoided.

The number of recording elements disposed in the inkjet recording head tends to increase, and also, the arrangement density thereof tends to become higher. Hence, the number of blocks for the foregoing time-division drive increases. As a result, an embodiment of the temperature control for every block of the recording elements is accompanied by an additional increase in the number of terminals of the recording elements. Also, since the complicated circuit configuration for controlling the recording elements increases the size of the control circuit on the element substrate of the inkjet recording head, the occupied area of the control circuit increases. For example, in the case of a color inkjet recording head including at least 256 pieces of recording elements, three kinds of ink of cyan, yellow, and magenta colors, a minimum combination for achieving a color image, are prepared. This structure makes the size of the control circuit for individually turning on/off heaters (electrothermal converters) serving as these recording elements large and the occupied area on the element substrate, of even only control wiring lines of the circuit, is also large. When the recording element rows are arranged on both sides of a ink supply port, the control wiring lines simply require a double wide area with the known technique, and many problems including the number and arrangement places of outgoing lines of the terminals of the heating devices remain, thereby causing an obstacle against manufacturing a color inkjet recording apparatus at low cost.

SUMMARY OF THE INVENTION

In order to solve the above problems, the present invention is directed to a recording-head element substrate, a recording head including the recording-head element substrate, and a recording apparatus including the recording head.

According to one aspect to the present invention, a recording-head element substrate having a plurality of recording elements arranged thereon in a row pattern and includes at least one functional element controlling application of electric current on the recording elements, at least one common electrode energizing the plurality of recording elements, at least one logic circuit selectively driving the recording elements, a plurality of temperature-adjusting heating devices, and at least one heat-controlling circuit individually controlling the plurality of heating devices. Control information for individually controlling the plurality of heating devices is externally received via the same input terminal as that of image information inputted to the logic circuit selectively driving the recording elements or information for controlling a time-division-drive of the row of the recording elements.

With this structure, the number of terminals of the inkjet recording head is reduced, and the temperature of the plurality of heating devices is individually controlled.

According to the present invention, compensating for a change in the recording element characteristic due to a fine temperature change of the recording head substrate is obtained. Also, when the heating devices are arranged in a unit of a plurality of blocks, an accurate temperatures control is achieved for each sub-heater arrangement region.

Further features of the present invention will become apparent from the following description of exemplary embodiments with reference to the attached drawings.

BRIEF DESCRIPTION OF THE DRAWINGS

FIG. 6 is a table of heat process control of each sub-heater.

DESCRIPTION OF THE EMBODIMENTS

First Embodiment

Exemplary embodiments of the present invention will be described with reference to the attached drawings. A term "recording" or "record" described in the present invention means not only providing a recording medium with an image including a character, a figure or the like containing a meaning but also that including a pattern containing no meaning.

A term "element substrate" is not limited to indicating a base material including a semiconductor but also indicates a substrate including elements, circuits, terminals, and so forth. The substrate may have a plate-like or a chip-like shape.

A term "on the element substrate" indicates "on the substrate" but also "on the surface of the substrate" and "in the inside of the substrate close to the surface". A term "built-in" described in the present invention is not limited to indicating "arranging independent elements on the substrate" but also indicates "integrally forming the elements on the substrate through a manufacturing process of a semiconductor circuit or the like.

Recording Apparatus According to the Present Invention

Figure 10:
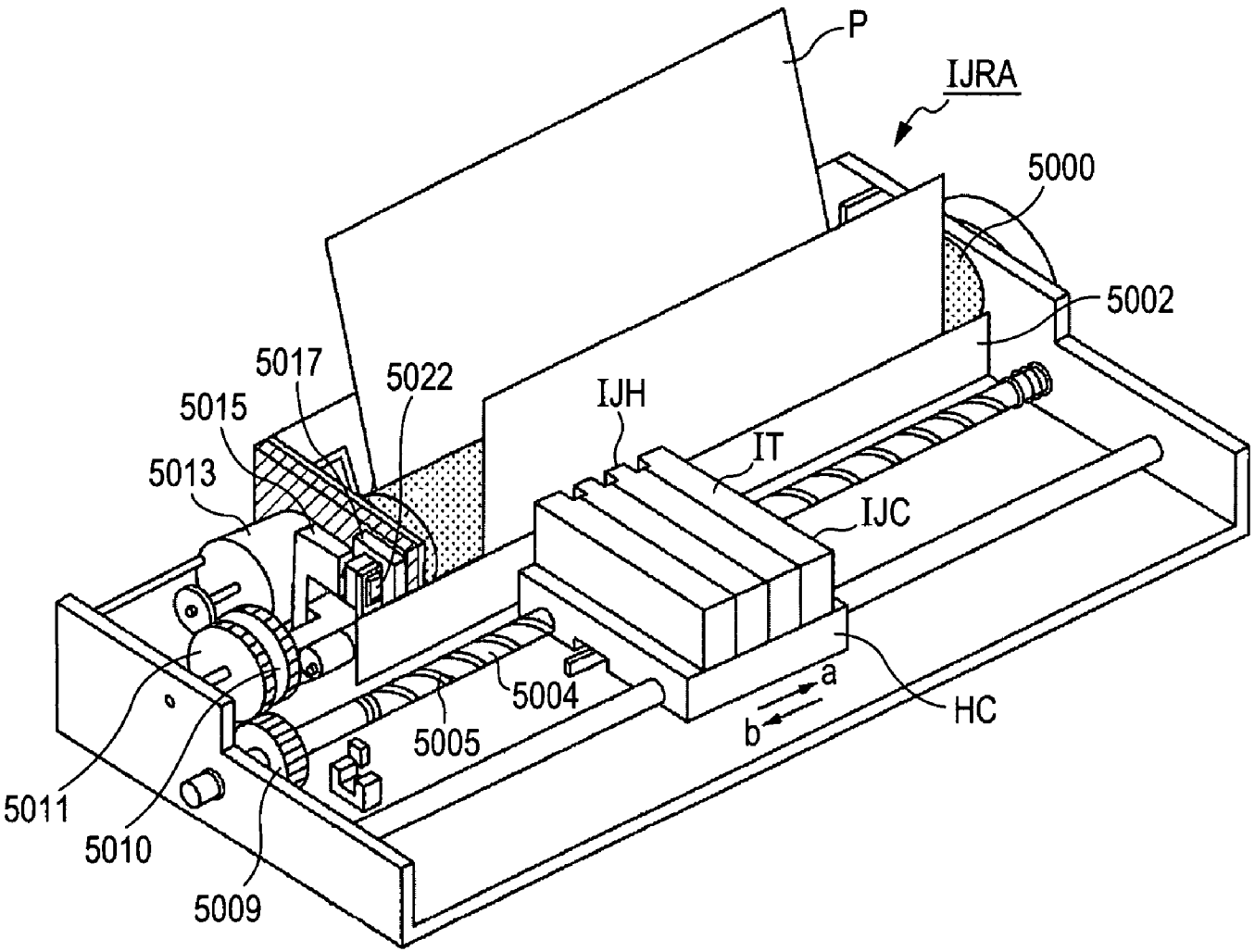
FIG. 10 is a schematic view of an inkjet recording apparatus according to an embodiment of the present invention.

FIG. 10 is a schematic view of an inkjet recording apparatus IJRA according to an embodiment of the present invention. In the figure, a lead screw 5004 rotates via drive-force transmission gears 5010, 5011, and 5009 in conjunction with forward or reverse rotation of a carriage motor 5013. A head cartridge HC includes a pin (not shown) engaging with a screw groove 5005 of the lead screw 5004 and is reciprocally moved in a and b arrow directions according to rotation of the lead screw 5004. The head cartridge HC includes an inkjet cartridge IJC. The inkjet cartridge IJC includes an inkjet recording head IJH and an ink-tank IT for storing recording-use ink.

A paper-pressing plate 5002 presses a sheet of paper against a platen 5000 over the moving range and along the moving direction of the carriage. The platen 5000 rotates with a transport motor (not shown) so as to transport a sheet of recording paper P (hereinafter, referred to as a recording paper P). A suction mechanism 5015 sucking the inside of a cap member 5022 sucks and restores the inkjet recording head while capping it with the cap member. One skilled in the art will understand that a cleaning blade 5017 may have a known structure other than that shown in the figure.

The recording apparatus has a structure such that, when the carriage moves in a region close to its home position, a desired process of capping, cleaning, or sucking and restoring is achieved at the corresponding position with an operation of the lead screw 5004. Any structure is applicable to the present embodiment as long as a desired one of these processes is performed at a known timing.

Figure 11:
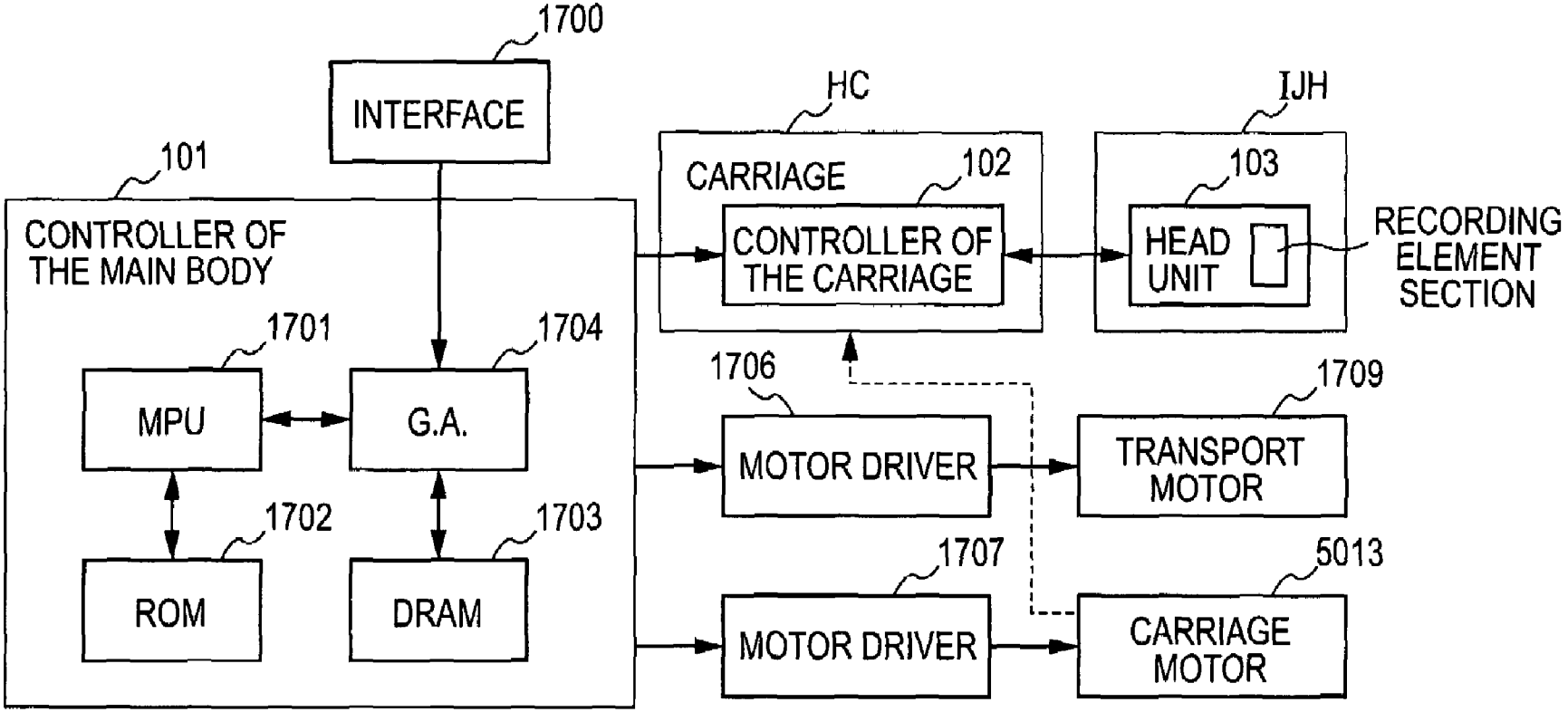
FIG. 11 is a block diagram of the general control configuration of the inkjet recording apparatus.

Referring now to FIG. 11, the control configuration for performing recording control of the recording apparatus will be described. FIG. 11 is a block diagram of the general control configuration of the inkjet recording apparatus. As shown, a controller 101 of the main body of the recording apparatus includes an interface 1700 accepting a recording signal, a micro-processing unit (MPU) 1701, a program read-only memory (ROM) 1702 for storing a control program executed by the MPU 1701, a dynamic random access memory (hereinafter, referred to as a DRAM) 1703 for storing various kinds of information (such as the above-described recording signal and recording information fed to the recording head), and a gate array (in the figure, represented by G.A.) 1704 for performing feed control of recording information to an inkjet recording head IJH and information for drive control of sub-heaters, which will be described later, in addition to performing information transfer control among the interface 1700, the MPU 1701, and the DRAM 1703.

A transport motor (not shown in FIG. 10) 1709 transports the recording paper P. Motor drivers 1706 and 1707 respectively drive the transport motor 1709 and a carriage motor 5013.

An operation of the foregoing control configuration will be described. When the interface 1700 receives a recording signal, the recording signal is converted into print-use recording information between the gate array 1704 and the MPU 1701. Then, the motor drivers 1706 and 1707 are driven, and the inkjet recording head IJH is driven on the basis of recording information transmitted to the head cartridge HC. With this arrangement, an image is recorded onto the recording paper P.

In order to optimally drive a recording element section of the inkjet recording head IJH, upon driving it, characteristic information stored in a memory included in a head unit 103 in the inkjet recording head IJH is referenced, and a drive pattern of each recording element is determined.

Figure 12:
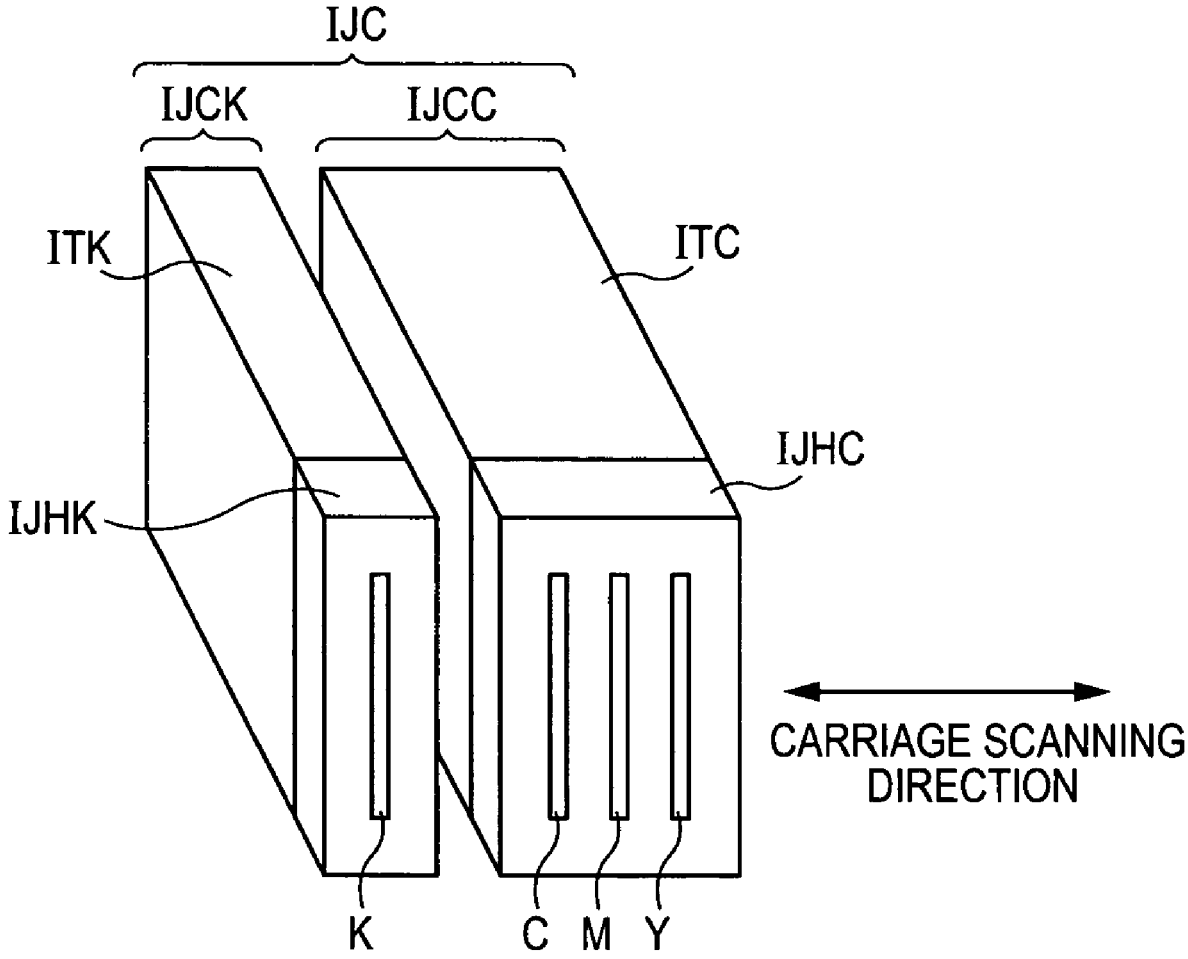
FIG. 12 is an external perspective view of the structure of the recording head.

FIG. 12 is an external perspective view of an example structure of the inkjet cartridge. The head carriage HC described here includes the ink cartridge IJC and the inkjet recording head IJH integrated with each other, although these components may be independently placed from each other.

As shown in FIG. 12, the inkjet cartridge IJC is composed of a cartridge IJCK discharging black ink and a cartridge IJCC discharging three kinds of color ink of cyan (C) magenta (M), and yellow (Y) colors. These two cartridges are separable from each other and independently detachable from the head cartridge HC.

The cartridge IJCK includes an ink tank ITK storing black ink and a recording head IJHK discharging black ink, and these are integrated with each other. Likewise, the cartridge IJCC is composed of an ink tank ITC storing the C, M, and Y ink colors and a recording head IJHC discharging these color inks for a recording operation. These components are integrated with each other. The head cartridge according the present embodiment has a structure having ink filled in the corresponding ink tank.

Also, as is shown in FIG. 12, rows of nozzles (K, C, M, Y) discharging respective colors of ink are juxtaposed with each other in a carriage moving direction, and an arranging direction of the nozzles intersects with the carriage moving direction.

Figure 13:
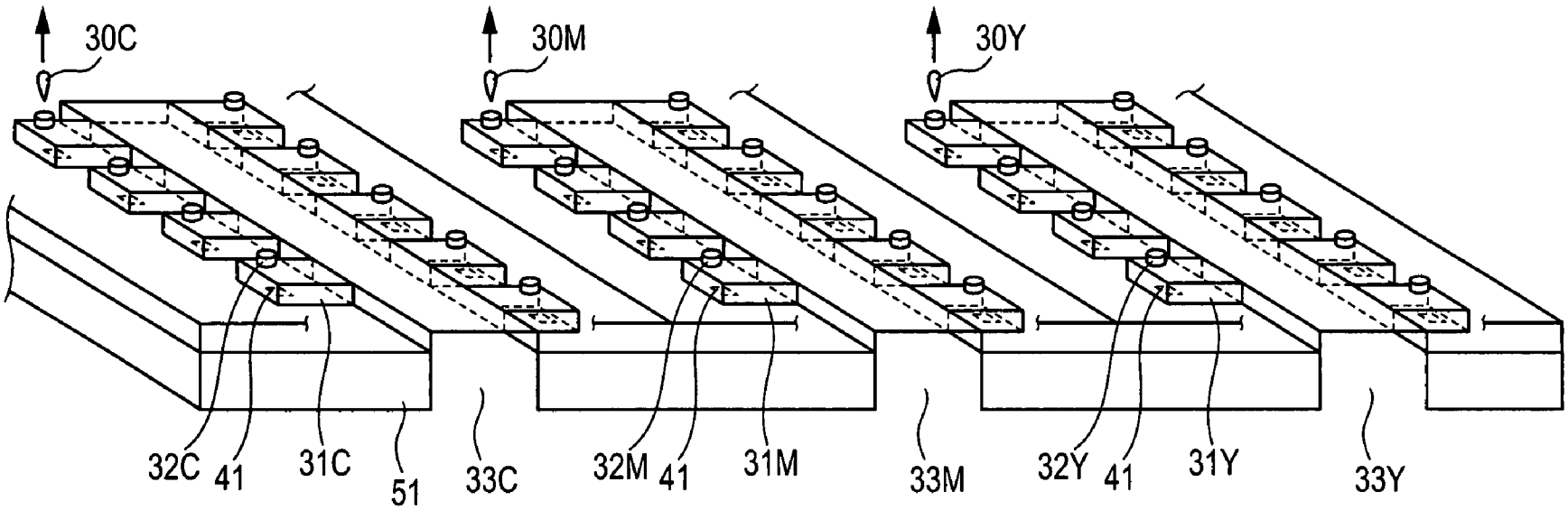
FIG. 13 is a perspective view of the three-dimensional structure of the recording head discharging three kinds of color ink.

Referring now to FIG. 13, an element substrate for use in the inkjet recording head IJH of the recording apparatus having the above structure will be described. FIG. 13 is a perspective view of the three-dimensional structure of the recording head IJHC discharging three kinds of color ink.

The recording head IJHC includes ink channels 33C, 33M, and 33Y feeding the corresponding kinds of ink of C, M, and Y colors respectively, and feed routes (not shown) for feeding the respective ink from the ink tank ITC to the corresponding ink channels are provided on the rear surface of the substrate.

The three kinds of ink of C, M, and Y colors are respectively introduced by ink flow paths 31C, 31M, and 31Y to heaters (such as electrothermal converters) 41 arranged on the substrate while passing through the respective ink channels. When the electrothermal converters 41 are energized through a circuit, which will be described later, ink lying on the electrothermal converters 41 is provided with heat and comes to a boil. As a result, generated bubbles cause ink liquid 30C, 30M, and 30Y to be discharged from discharge ports 32C, 32M, and 32Y arranged so as to correspond to the respective electrothermal converters.

An element substrate 51 shown in FIG. 13, of each head has electrothermal converters, which will be described later, and a variety of circuits driving the electrothermal converters, a memory, a variety of pads serving as electrical contacts with the head cartridge HC, and a variety of signal lines formed therein.

A single electrothermal converter, a metal oxide semiconductor (MOS) field effect transistor (FET) (i.e., a MOS-FET) for driving the foregoing conversion member, and so forth are collectively called a recording element, and a plurality of recording elements is collectively called a recording element section.

Both the inkjet recording head IJHC shown in FIG. 13, which discharges color ink, and the inkjet recording head IJHK, which discharges black ink, have a three-dimensional structure. That is, the inkjet recording head IJHK includes a single ink channel, and the size of its element substrate is about one third of that of the element substrate 51.

Figure 14:
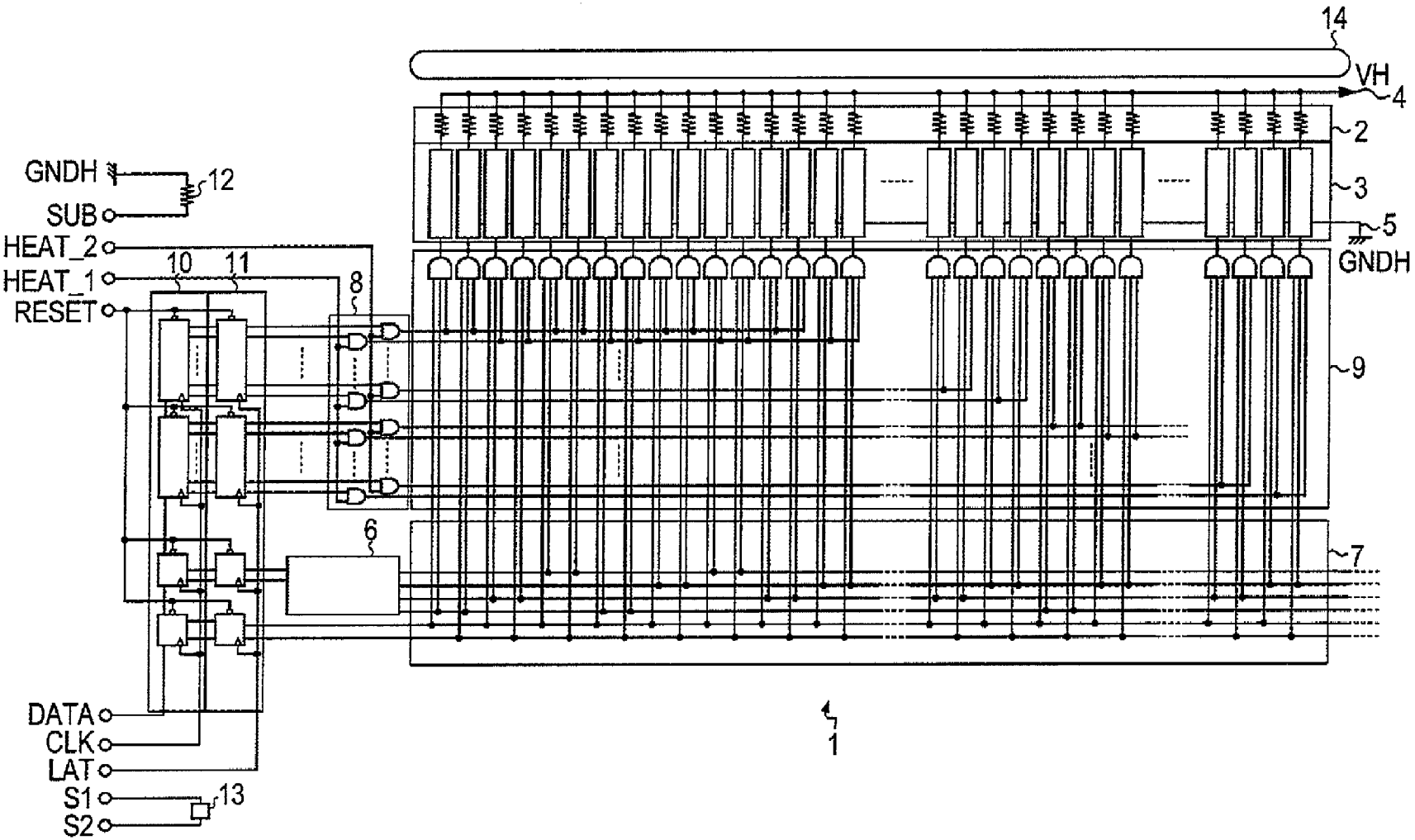
FIG. 14 is a layout diagram of the circuit configuration of an element substrate of a recording head made according to a related art of the present invention, on which the present invention depends.

FIG. 14 is a layout diagram of the circuit configuration of an element substrate of a recording head according to the related art. As an example structure, an inkjet-recording-head element-substrate 1 has a plurality of recording elements (formed in a single row in the figure, also referred to as electrothermal converters, a recording element row, or an electrothermal converter row) 2 and an ink supply port 14 feeding ink to ink discharge nozzles (not shown) structurally arranged on the corresponding recording elements formed thereon, for example, by anisotropic etching or sandblasting. The recording element row 2 is aligned in a line (including a structure in which the recording elements are finely displaced in a unit of several nozzles) with respect to the ink supply port 14. Although described later, the recording elements are connected to a control circuit so as to be selectively driven according to recording image information.

The element substrate 1 also has a functional element row (a driver row) 3 composed of, for example, MOS-FETs individually controlling drive of conversion members 2, and circuit wiring lines 9 making the individual control possible, subsequently arranged thereon. The element substrate 1 may have power-feeding common electrodes (VH) 4 and power-source-grounding common electrodes (GNDH) 5 arranged thereon so as to sandwich the electrothermal converter row and the functional element row or to form multiple layers with functional elements. The common electrodes can be arranged in concert with the structure of the inkjet recording head.

Many of the recently developed inkjet-recording-head element-substrates include not only the above-described electrothermal converters, but also a group of functional elements such as a driver row and its control circuit built therein and hence contributes to cost reduction of the overall recording apparatus. Of these components, register circuits 10, latch circuits 11, and so forth play an important role for individually controlling the recording elements of the recording element row extending over several hundreds of nozzles. With this arrangement, even when the number of the recording elements increases, it is not needed to increase the number of control terminals in agreement with the number of the recording elements. Hence, an element substrate including a control circuit configured with a combination of the above-described circuits is currently a mainstream approach.

A control circuit 6 shown in FIG. 14 outputs signals to time-division drive-signal-group wiring lines 7 and applies a time-division drive on recording element groups to be individually selectively controlled. The control circuit usually includes a decoder circuit and a shift register circuit. Energizing-time-setting AND-circuit rows 8 apply electric current on electrothermal converters serving the recording elements. In the case of an inkjet recording head, concurrent drive of adjacent recording elements causes a so-called cross-talk phenomenon in the vicinities of ink flow paths of the recording heads to occur due to an ink flow speed. Since the cross-talk sometimes causes an ink droplet discharged from a discharge nozzle to become unstable, the adjacent electrothermal converters are separately controlled so as to avoid them being concurrently driven.

In this example structure, by making heater values and nozzle shapes of the adjacent electrothermal converters different from each other, discharge of mutually different amounts of ink is achieved. As described above, large and small heaters (electrothermal converters) discharging different amounts of ink are arranged one after another so as to undergo drive control as a pair. The drive control is achieved, taking account into the cross-talk, by the circuit configuration including the large and small heaters as pairs. By applying energizing signals on terminals called HEAT_1 and HEAT_2, the pairs of the large and small heaters can be controlled.

Signals of the latch circuits 11 for individually controlling the electrothermal converters and AND output signals of the HEAT_1 and HEAT_2 respectively serve as inputs of the individual-control circuit wiring lines 9 and a row of AND circuits. An output of the AND circuit depends on the time-division drive-signal-group wiring lines 7 receiving output signals of the time-division decoder circuit 6. While these signal lines are set so as to correspond to respective drive blocks of the inkjet recording head, and a variety of methods for time-division, selection circuits, structures of wiring are provided, the present invention is not limited to the above-described structure.

A round end of each wiring line serves as a control terminal pad through which recording current is externally applied on the inkjet element substrate and the inkjet element substrate is controlled so as to achieve a recording operation. Since a plurality of control groups of wiring lines extending from the time-division drive circuit 7 is sometimes commonly used for a color inkjet recording head, these wiring lines are arranged in a manner of overlaying the surface of the inkjet-recording-head element-substrate 1.

In the inkjet recording head, while the temperature of the recording-head element-substrate itself rises when energized, in a low temperature environment, temperatures of both the ink and the head element substrate are low. As a result, the inkjet recording head is often incapable of fulfilling its original ink-discharging performance when an operation of discharging ink is started immediately after energization. As a countermeasure against this, the inkjet recording head includes sub-heaters 12 for heating the head element substrate so as to control its temperature. The sub-heater 12 is generally a resistive element composed of the same material as that of the electrothermal converter and built in the element substrate. Element-substrate temperature sensors 13 for detecting the environmental temperature of the inkjet recording head are additionally arranged. The temperature sensor 13 is often an element such as an aluminum resistive element or a diode element so as to be built in the same element substrate as that having the sub-heater 12 built therein.

While these elements for adjusting and controlling the temperature of the recording head offer the same effect as that of a method with which these elements are directly attached to the element substrate, when the degree of accuracy of directly detecting the temperatures of ink contacting with the head element substrate and the element substrate is required, building them in the same element substrate as each other has been the typical approach. With this structure, it is not necessary to attach temperature-adjusting and -controlling components to the inkjet recording head, thereby reducing the cost of the inkjet recording head.

Figure 15:
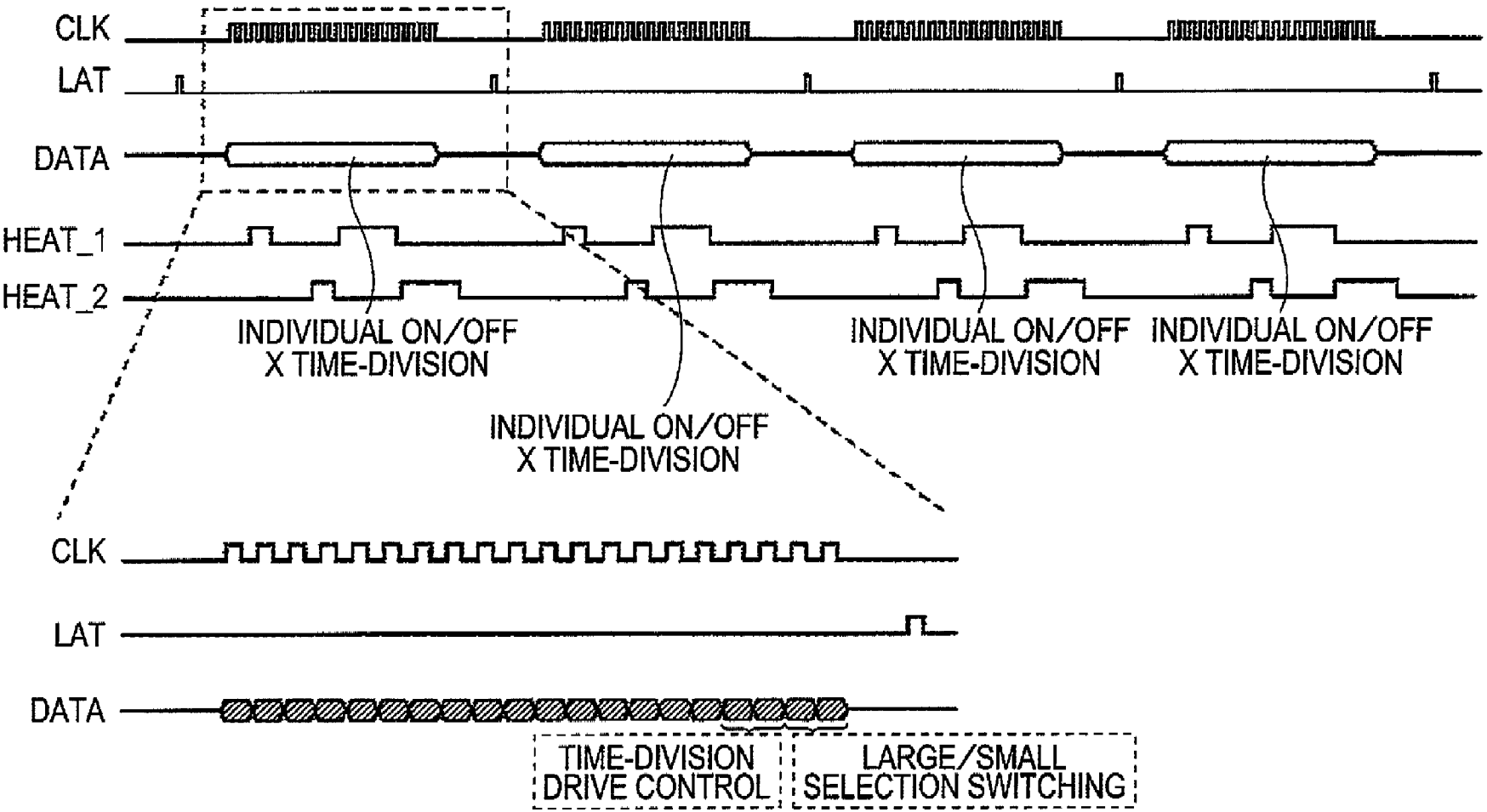
FIG. 15 is a drive-timing chart of the circuit of the recording head according to the related art of the present invention.

FIG. 15 is an example drive timing chart based on the circuit configuration of the recording head shown in FIG. 14. Image data serving as nozzle-row image information of the inkjet recording head is developed in the main body of the recording apparatus and is then inputted to a DATA terminal of the element substrate of the recording head. The information signal serving as serial information is supplied to the register circuits 10 serving as logic circuits and is temporally stored in the latch circuits 11 with an appropriate division width. A LAT terminal corresponds to a latch lock for storing the information. Since the information is held until the subsequent information is inputted, by inputting signals of the HEAT_1 and HEAT_2 for controlling energization of the electrothermal converters during that period, the electrothermal converters for an recording operation is selectively energized in response to the image information.

In recent years, in order to reduce the number of terminals of the inkjet recording head, in a known method, time-division setting information is also serially transferred to the DATA terminal serving as that of image data. As shown in the blown-up portion of the drive timing chart of FIG. 15, information for individually controlling 16 pieces of electrothermal converters, information for setting a block number of the electrothermal converters to be subjected to time-division control, and selecting information for driving either one of large and small heaters can be inputted to the DATA terminal.

With this driving timing, the heaters corresponding to 64 (16×4) nozzles can be driven according to image information selection of either large or small heaters. Since the information for individually controlling the electrothermal converters together with the time-division setting information at the same time can be set, the shift register circuits and the latch circuits corresponding to the number of all nozzles (64 nozzles) can be eliminated, thereby drastically reducing the size of the element substrate. Since addition of serial information bits corresponding to time-division drive control allows the number of blocks to increase in a binary exponential manner, information transfer with this structure is flexible over an increase in the number of recording elements.

When a HEAT signal is applied after the information is latched, recording current is applied on the electrothermal converters with a pulse width of the signal. By applying signals of the HEAT_1 and HEAT_2 in a shifted manner as shown in FIG. 15, the total period needed for inputting the pulse width can be shortened within a transfer-clock transmitting period. This is one of several measures for making the cycle of discharging ink as short as possible so as to achieve a high speed recording apparatus. As described above, some timing charts for driving the inkjet recording head can be set on the basis of the circuit shown in FIG. 14. According to a print mode or the like of the recording apparatus, times of the timing charts can be set.

On the basis of a structure including heaters (hereinafter, referred to as sub-heaters) which are arranged on the element substrate having the above-described example circuit configuration and which serve as temperature-adjusting heating devices, circuit configurations and control of the sub-heaters according to embodiments of the present invention will be described in detail.

First Embodiment

Figure 1:
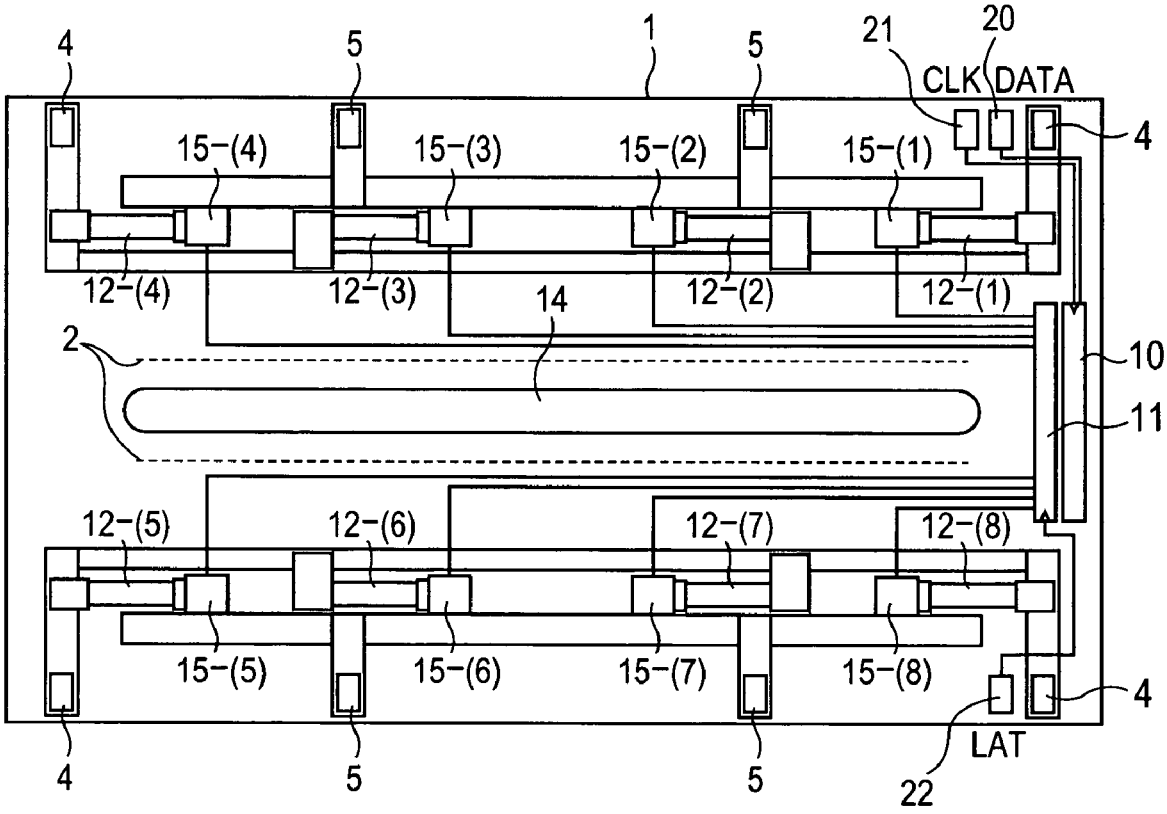
FIG. 1 is a partial diagram of the structure of a recording head according to a first embodiment of the present invention.

FIG. 1 is a diagrammatic view illustrating a characteristic part of the structure of a recording head according to a first embodiment of the present invention. As an example structure of the recording head, on the inkjet-recording-head element-substrate 1, a plurality of the electrothermal converters (e.g., resistive elements) 2 for discharging ink and discharge ports arranged so as to correspond to the respective electrothermal converters, and the ink supply port 14 for feeding ink to the discharge ports are formed. The ink supply port 14 is formed by anisotropic etching or sandblasting. As described above, the electrothermal converters are connected to the control circuit so as to be selectively driven in response to recording image information.

In order to clearly depict the structure of the heating devices (the sub-heaters), the functional driver row (the driver row) such as the MOS-FET row for selectively controlling drive of the conversion members 2, the circuit wiring lines allowing the respective electrothermal converters to be individually controlled, and so forth are not shown in the FIG. 1. The power-feeding common electrodes (VH) 4 and the power-source-grounding common electrodes (GNDH) 5 are commonly connected to the electrothermal converters and the functional elements for discharging ink. These electrodes are individually connected to the sub-heaters 12 for heating the element substrate so as to adjust its temperature and also to sub-heater-controlling functional elements 15. While the sub-heaters 12 are typically arranged in parallel to each block of the electrothermal converter row, the arrangement of the sub-heaters 12 can be arbitrarily set according to the structure of the inkjet recording head. Depending on the circumstances, the sub-heaters 12 may be arranged so as to form multiple layers with functional wiring lines other than those for the sub-heaters 12.

The sub-heaters 12 and the corresponding functional elements (drivers) 15 according to the first embodiment are arranged in parallel to the respective blocks of the electrothermal converter row. Each has a structure of eight blocks in total, where each of its two rows are divided into four blocks, and the divided blocks of the sub-heaters 12 and the functional elements 15 are respectively denoted by 12-(1) to 12-(4) and 15-(1) to 15-(4) on one row and 12-(5) to 12-(8) and 15-(5) to 15-(8) on the other row. One ends of the sub-heaters 12 are commonly connected to the common electrodes VH 4 and subjected to application of the same voltage as that applied on the electrothermal converters. The sizes of the sub-heaters 12 are determined so as to obtain respective resistances for optimally adjusting the temperature on the element substrate. All sub-heaters 12 may have the same resistance as one another or the sub-heaters 12 may have different resistances from one another. The resistances of the sub-heaters 12 may be the same through all sub-heaters 12 or different from one another depending on the arrangement positions of the sub-heaters 12 or the like.

The other ends of the sub-heaters 12 are connected to the sub-heater-controlling functional elements 15, and energization feedback current of the sub-heaters 12 flows in the power-source-grounding common electrodes (GNDH).

By connecting a part of the output line of each latch circuit 11, serving as a part of a logic circuit for individually controlling the electrothermal converters, to the control input line of each sub-heater-controlling functional element 15, the most characteristic structure of the first embodiment of the present invention is obtained. In other words, each sub-heater-controlling functional element 15 functions in response to information inputted in the latch circuits 11.

A control resolution (the controllable minimum time unit) of the functional element 15 is based on an update period of image data of each of the latch circuits 11. More particularly, the control resolution depends on timings for applying a time-division drive on the electrothermal converters. Functioning of the sub-heater-controlling functional elements 15 individually with this cycle means that each sub-heater 12 is arbitrarily heated and controlled in response to the number of driving operations when the electrothermal converters are subjected to a time-division drive. Other than the above structure, both ends of each sub-heater 12 and each sub-heater-controlling functional element 15 are connected to the common electrodes VH 4 and GNDH 5.

In order to input information for controlling each sub-heater 12, a DATA terminal, a CLK terminal, and a LAT terminal, which are existing terminals and used for logic circuits such as shift register circuits and decoder circuits used upon a recording operation, are commonly used. As a result, arrangement of additional terminals on the element substrate of the inkjet recording head is not needed. In addition, even when the number of the sub-heaters 12 increases, the terminal pads of the recording head does not cause an increase in the area of the element substrate. Hence, a change in the discharge characteristic of small droplet ink due to a fine temperature change can be compensated for. Also, even when the sub-heaters 12 are arranged in a unit of plurality of blocks, the inkjet recording head has the same number of terminals as those of the known one.

Figure 2:
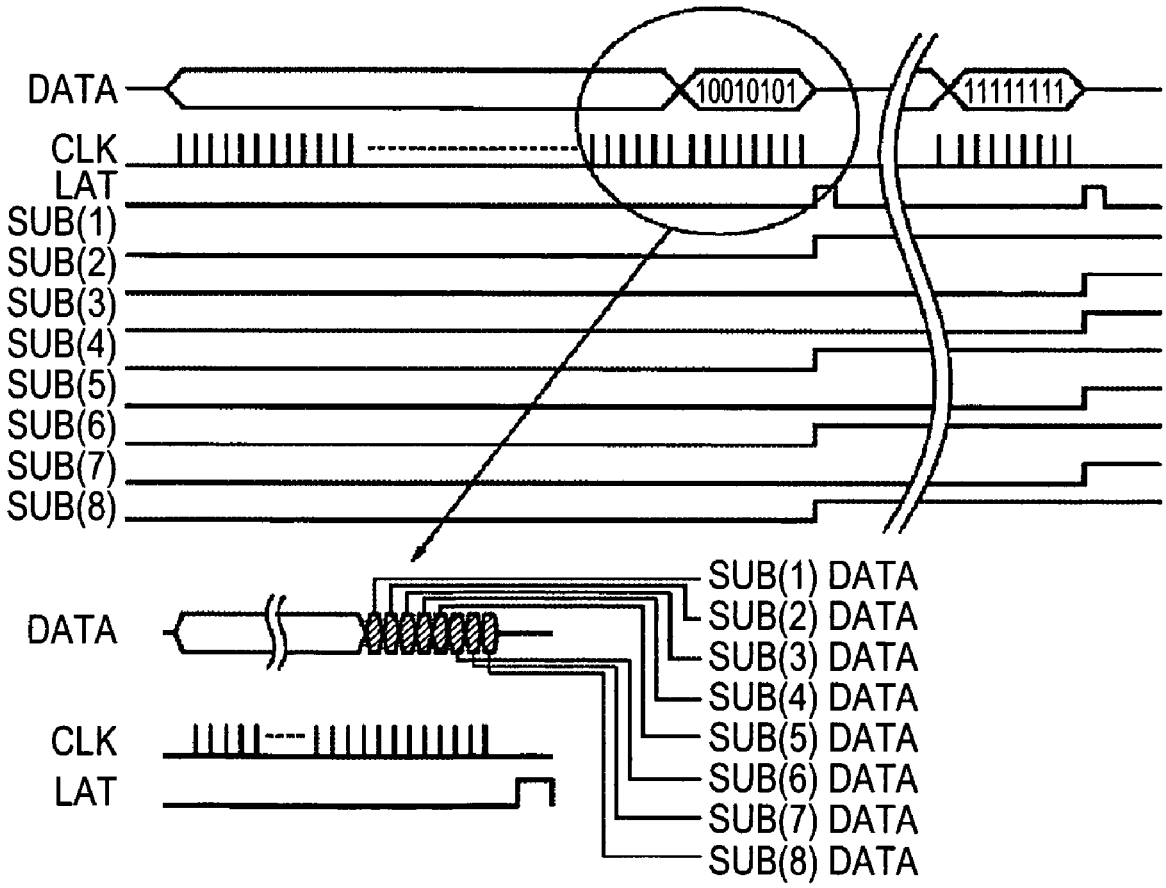
FIG. 2 is a drive-timing chart of sub-heater control of the recording head.

FIG. 2 is a drive timing chart for controlling the sub-heaters 12 of the recording head having the structure shown in FIG. 1, according to the first embodiment of the present invention. With this structure, individual drive information such as image data to be supplied to each block of the electrothermal converters is serially transferred to the DATA terminal. The sub-heater control is achieved by setting a bit for individually controlling the respective sub-heater-controlling functional elements 15 after the transfer.

Each piece of sub-heater control information is also transferred, together with the individual drive information supplied to a block of the electrothermal converters, on a clock inputted to the CLK terminal. Serial information set in the register circuits 10 is temporarily held in the latch circuits 11 triggered by a rising signal of the LAT terminal. In the state on this moment, if information shown in the circle in FIG. 2 is taken up by way of example, where on is "1" and off is "0", information to be transferred to the respective sub-heater-controlling functional elements 15 is "1", "0", "0", "1", "0", "1", "0", and "1" in order from SUB (1) to SUB (8) of the sub-heaters 12. As described above, on and off switching of the respective sub-heaters 12 is individually designated.

This timing chart illustrates the state corresponding to SUB (1) to (8). The state is updated upon input of individual drive information of the subsequent block of the electrothermal converters. If the following information shown in FIG. 2 is inputted, all SUB (1) to (8) are updated to "1". Timings of turning on and off each of sub-heater-controlling functional elements 15 are sequentially set from the recording apparatus as described above, thereby achieving high-performance temperature control of the inkjet recording head.

Second Embodiment

Figure 3:
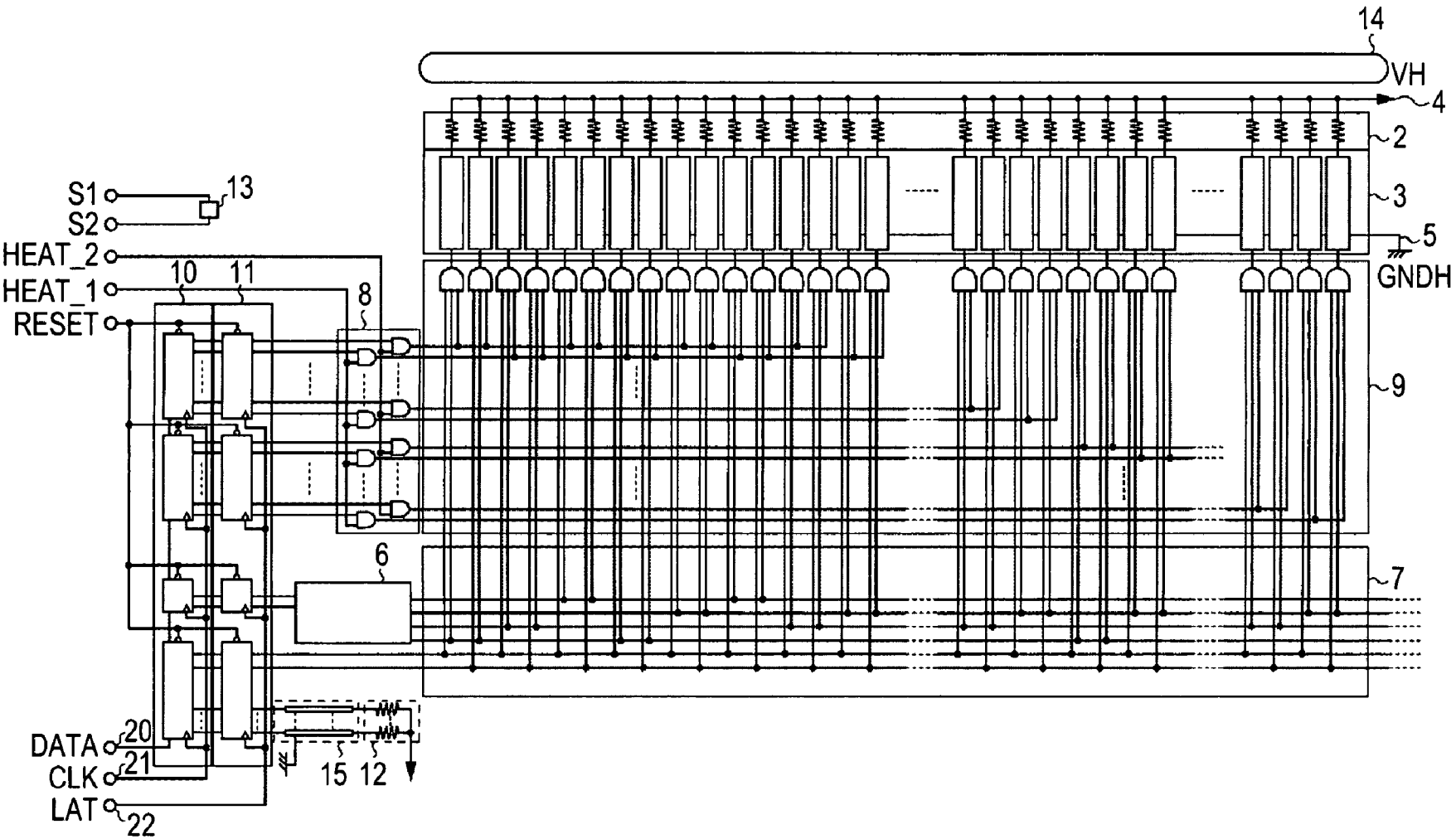
FIG. 3 is a layout diagram of a partial circuit of the recording head according to a second embodiment of the present invention, arranged on an element substrate.

FIG. 3 is a layout diagram of a partial circuit of the recording head according to a second embodiment of the present invention, illustrating the circuit configuration on the element substrate depending on the structure of the recording head according to the related art shown in FIG. 14. In the figure, the plurality of electrothermal converters (in the figure, formed in a single row) 2 and the ink supply port 14 are shown. The electrothermal converter row 2 is arranged so as to face the ink supply port 14. Similar to those of the related art shown in FIG. 14, the electrothermal converters are connected to the control circuit so as to be selectively driven in response to recording image information. As described above, the functional element row (the driver row) 3 composed of, e.g., MOS-FETs, for individually controlling drive of the electrothermal converters, the common electrodes VH 4 and GNDH 5, and the wiring lines 9 are arranged.

The common electrodes VH and GND may be arranged so as to sandwich the electrothermal converter row and the functional element row or to form multiple layers with the functional elements. The common electrodes can be arranged in conceit with the structure of the inkjet recording head.

The circuit configuration includes the register circuits 10 and the latch circuits 11 as described above. The control circuit 6 outputs signals to the time-division drive-signal-group wiring lines 7 and applies a time-division drive on the electrothermal converter group to be individually selectively controlled. The control circuit 6 usually includes a decoder circuit and a shift register circuit. The energizing-time-setting AND circuit row 8 applies recording current on the electrothermal converters.

In this structure of the inkjet recording head, by making heater values and nozzle shapes of the adjacent electrothermal converters different from each other, mutually different amounts of ink are discharged. By applying energizing signals to terminals called HEAT_1 and HEAT_2, these electrothermal converters can also be controlled. Signals of the latch circuits 11 for individually controlling the electrothermal converters and an AND output of signals of the HEAT_1 and HEAT_2 respectively serve as inputs of the individual-control circuit wiring lines 9 and the AND circuit row.

An output of the AND circuit depends on the time-division drive-signal-group wiring lines 7 to which the time-division decoder circuit 6 outputs a signal. While these signal lines are set so as to correspond to respective drive blocks of the recording head, and a variety of methods for time-division, selection circuits, and structures of wiring are provided, the present invention is not limited to the above-described structure.

The second embodiment of the present invention is characterized in that a part of an output line of each latch circuit 11 arranged next to the decoder circuit serves as a control line extending to the corresponding sub-heater-controlling functional element 15. As described above, one end of each sub-heater-controlling functional element 15 is connected to the corresponding sub-heater 12 so as to control the temperature of the sub-heater.

Also, as described above, the temperature sensors 13 are arranged on the element substrate for heating the element substrate so as to control its temperature. Hitherto, a plurality of points for detecting the temperature of the recording head is prepared. Since a recently developed recording head has a thinner thickness, heat is conducted in the head more quickly. While a variety of arrangements of the temperature sensors are proposed, the sensors in the present embodiment are arranged so as to obtain the average temperature of the overall element substrate.

Third Embodiment

Figure 4:
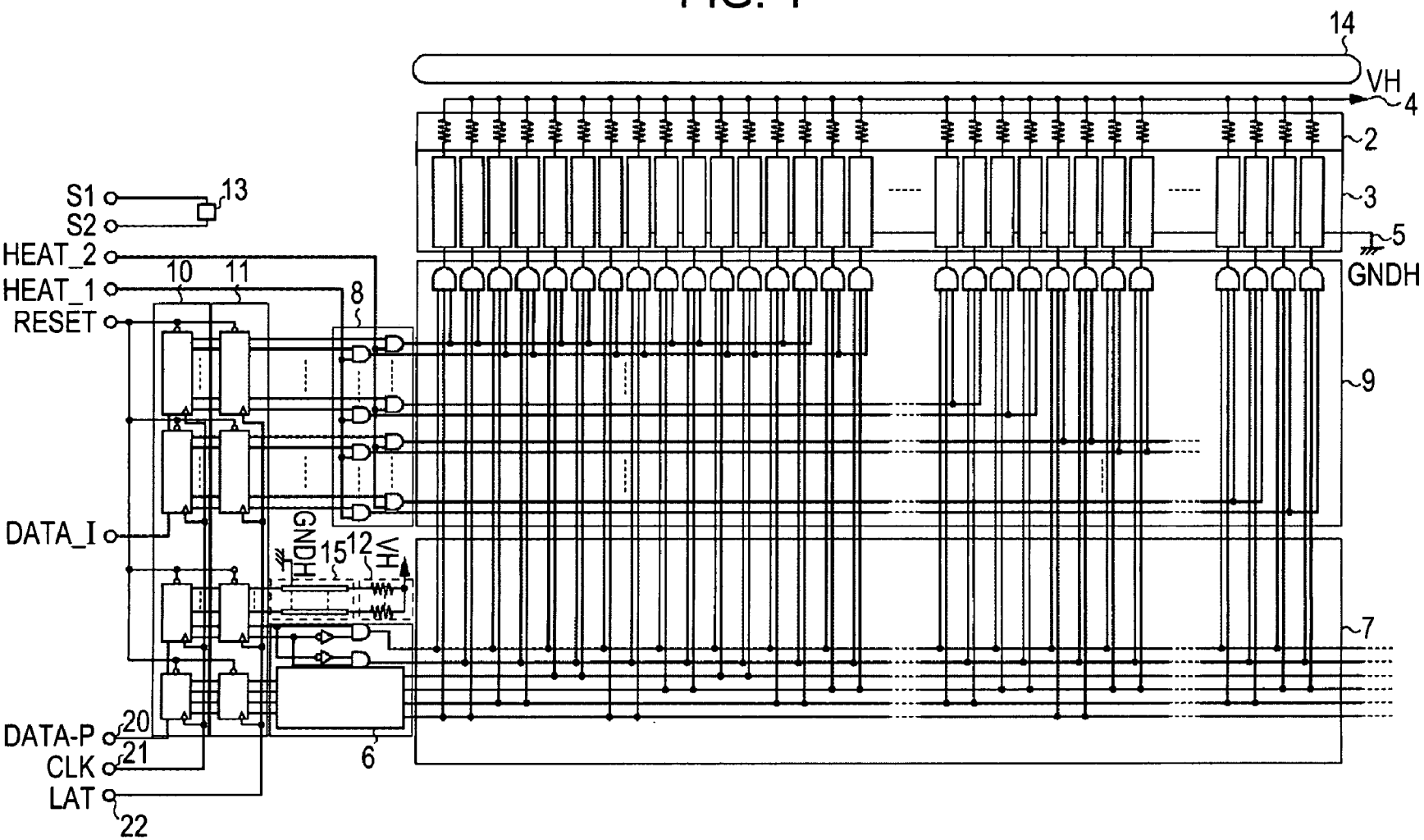
FIG. 4 is a layout diagram of a partial circuit of another recording head according to a third embodiment of the present invention, arranged on the element substrate.

FIG. 4 is a layout diagram of a partial circuit of an example circuit configuration of a recording head according to a third embodiment of the present invention. The circuit configuration is limited so as to illustrate functions of the inkjet recording head in comparison to those shown in FIG. 3. With this structure, the electrothermal converters respectively corresponding to large and small droplets are not concurrently driven. Also, input terminals for individual on/off information and those for a time-division drive and the other functional information are separated from each other. With this structure, the signal input terminals are separated depending on their functions, thereby easily making clear drive-signal processing systems of the controller of the printer main body.

When the recording head has a plurality of feedback control functions accompanying the recording control functions, as described in the present embodiment so as to serve as independent functions, function-dependent parallel transfer is effective. Hitherto, the number of control bits for a large or small ink droplet and a time-division drive is not great in comparison to that of input terminals for individual on/off information serially transferred and including a large number of bits. Hence, the input terminals for individual on/off information and those for a time-division drive and the other functional information are often configured as shown in FIG. 3 without mutual separation. When, however, the number of sub-heater control circuits increases, as described in the present embodiment, the terminals for control information sometimes are divided as shown in FIG. 4.

While the register circuits 10 and the latch circuits 11 included in the present structure are respectively continuously arranged, inputs into the shift register circuits are divided into an input terminal DATA_I for individual on/off information of the electrothermal converters and an input terminal DATA_P for time-division drive information and other functional information. Although not shown in FIG. 4, two parallel input signals are shifted with the common transfer clock terminal CLK. In the same fashion as in FIG. 3, a latch output of the DATA_I serves as an input to one of the energizing-time-setting AND-circuit rows 8 for applying electric current on the electrothermal converters.

In above-described structure of the inkjet recording head, by making heater values and nozzle shapes of the adjacent electrothermal converters different from each other, mutually different amounts of ink are discharged. With the time-division drive-signal-group wiring line 7 receiving a signal from the time-division decoder circuit 6 and an output of a selector circuit for selecting a large or small ink droplet, the corresponding electrothermal converter generates optimal recording energy so as to discharge an ink droplet. While these signal lines are set so as to correspond to respective drive blocks of the recording head, and a variety of methods for time-division, selection circuits, and structures of wiring are provided, the present invention is not limited to the above-described structure.

On the precondition of an information input configuration in which individual on/off information of the electrothermal converters and information of the other functions are separated from each other, the third embodiment of the present invention is characterized in that a part of an output line of each latch circuit 11 arranged next to the time-division circuit (the decoder circuit) serves as a control line extending to the corresponding sub-heater-controlling functional element 15. As described above, one end of each sub-heater-controlling functional element 15 is connected to the corresponding sub-heater 12 so as to achieve the temperature control of the sub-heater.

Figure 5:
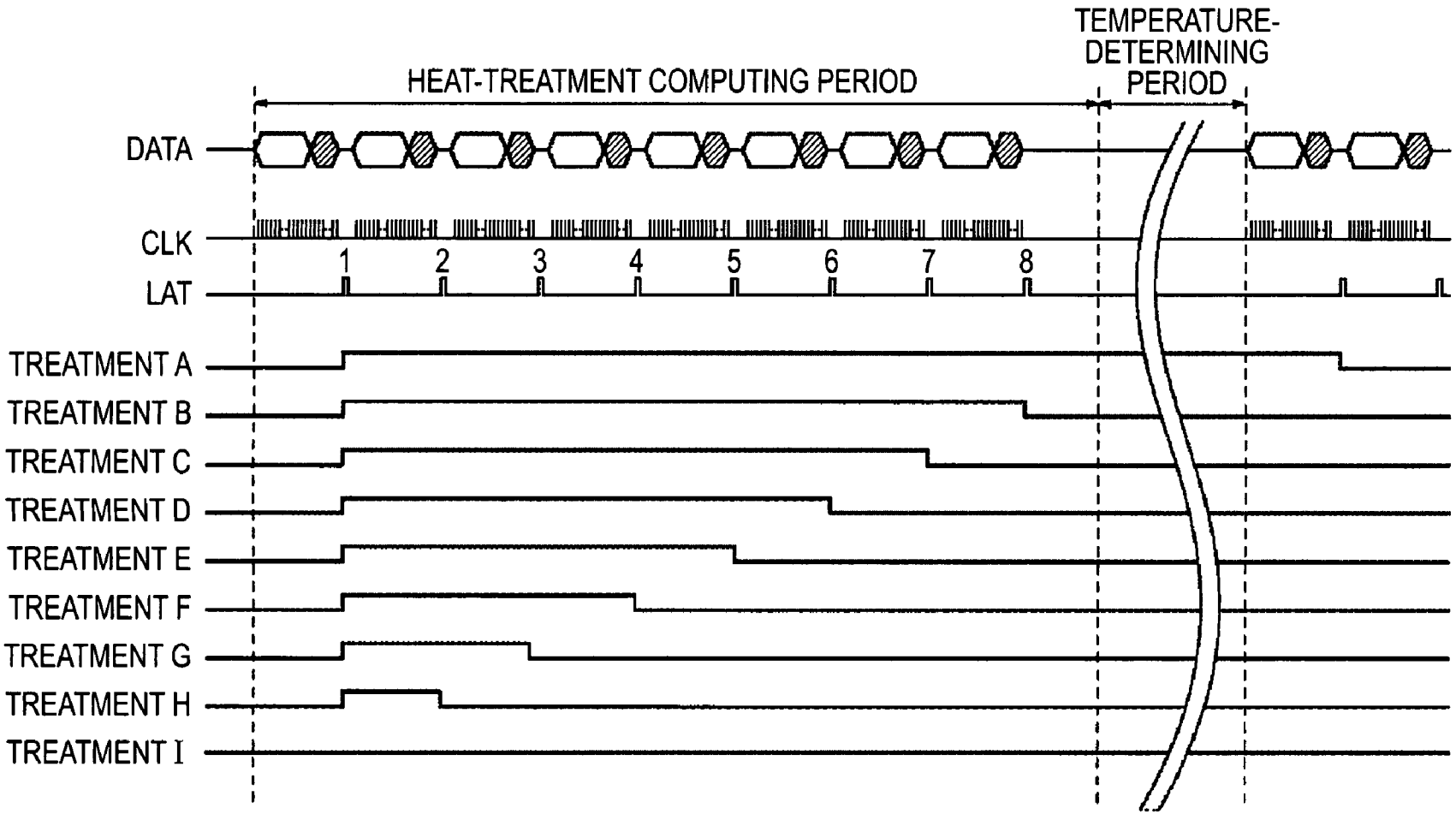
FIG. 5 is a timing chart of a control process pattern corresponding to a single sub-heater.

Embodiment of Recording Apparatus Including the Recording Head According to the Present Invention FIGS. 5 to 9 show control examples of a recording apparatus having the recording head according to either the first or the second embodiments having mutually the same structure regarding the input terminals for individual on/off information and those for a time-division drive and the other functions. FIG. 5 is a timing chart of a control process pattern corresponding to a single sub-heater.

As shown in the timing chart in FIG. 2, the single sub-heater is determined on the basis of a logic of specific bits in a DATA signal, and the signal allows a specific sub-heater to be continuously energized until being updated by an LAT signal.

According to the present embodiment, temperature-adjusting control is performed, according to an energizing state of the electrothermal converters, by setting nine steps (treatments A to I) of sub-heater energizing times. In the treatment A and in the treatment I, electric current is applied in the longest period and no electric current is applied, respectively. One of the treatments is selected by computing recording-image information and temperature-detection information of the recording apparatus, and the selected treatment is usually completed within the corresponding recording period. In the case of eight blocks of time-division drives, the present temperature of the element substrate is detected when the eighth LAT signal is outputted, and the detected temperature is reflected on the computation of the sub-heater energizing process.

FIG. 6 is a table of heat process control of the respective sub-heaters. The treatments A to I correspond to print duties of the arrangement regions of the respective sub-heaters, obtained from the recording-image information. When recording current is applied on the electrothermal converter, its environment temperature rises. Hence, the state of temperature-adjusting control of a region having each sub-heater arranged therein is updated. That is, a region on the element substrate (herein after, referred to as a sub-heater arrangement region) corresponding to each sub-heater cope is updated. For example, when a specific sub-heater arrangement region is not energized at all, the continuously energizing treatment of the treatment A is performed so as to maintain the environment temperature of the specific arrangement region until the corresponding sub-heater is energized, so as to be the same as that of other energized sub-heater arrangement regions. On the contrary, while the sub-heater corresponding to another specific sub-heater arrangement region is always energized, the treatment I is performed to apply no electric current on the sub-heater. By updating bits such that such control is applied to the respective sub-heaters, a high definition recording apparatus is provided.

Figure 7:
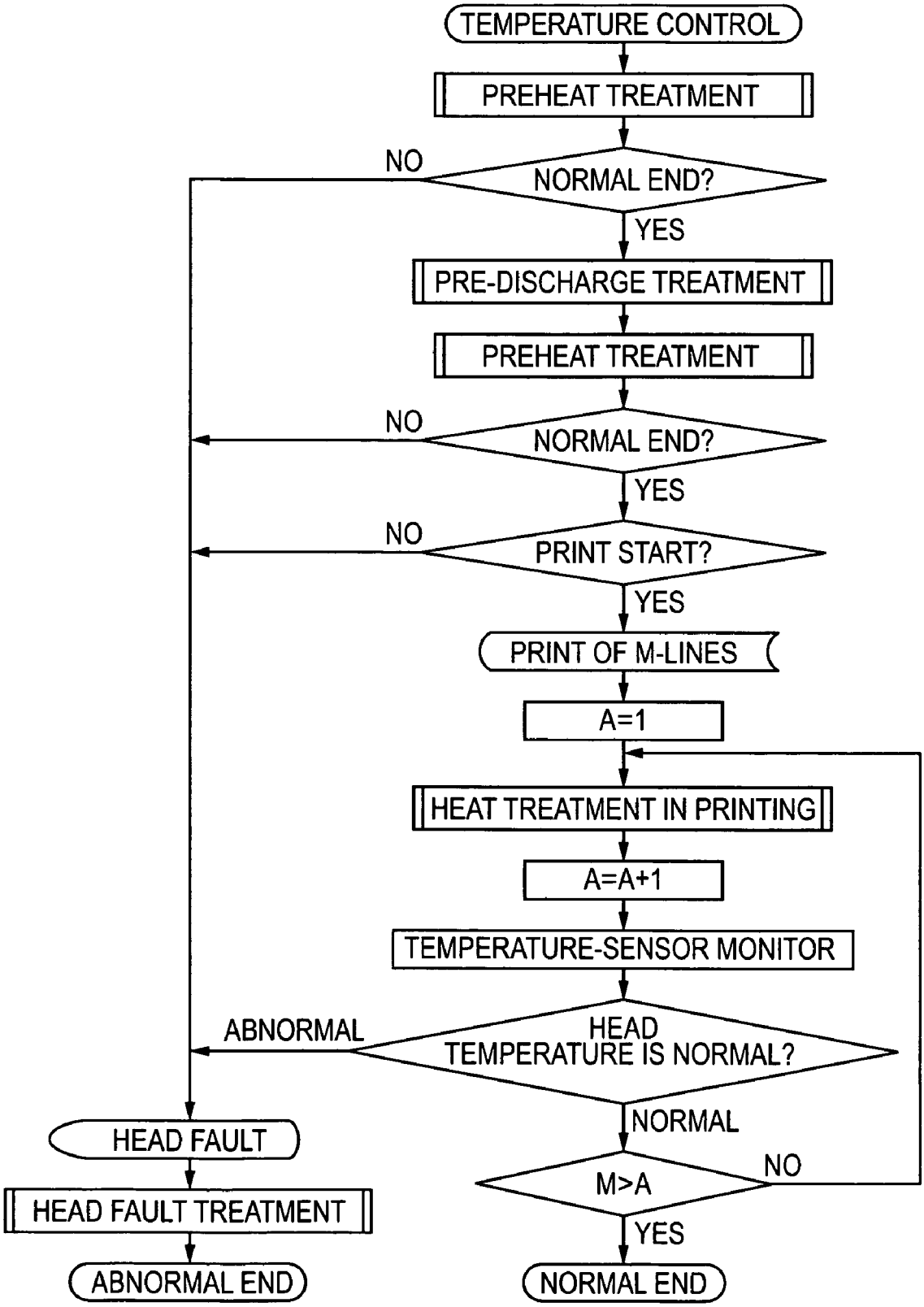
FIG. 7 is a flowchart of a basic temperature control sequence of a recording apparatus according to an embodiment of the present invention.
Figure 8:
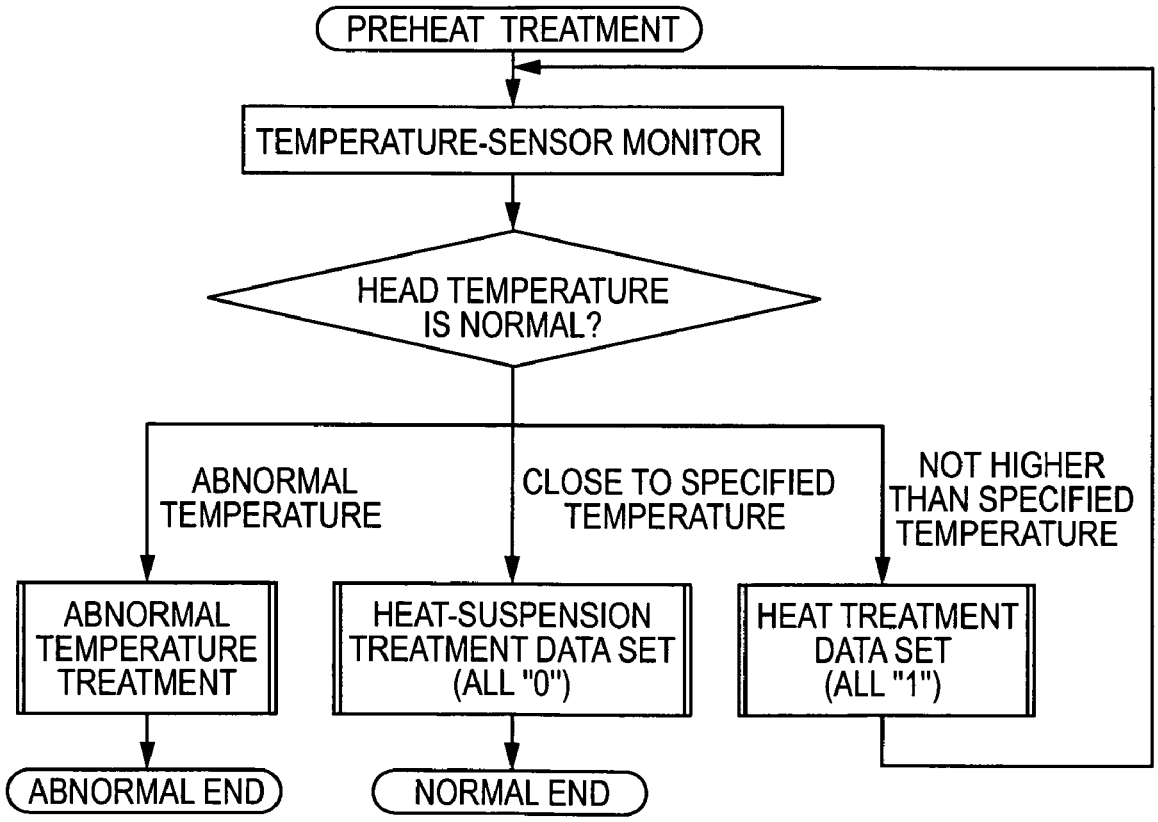
FIG. 8 is a flowchart of a basic preheat sequence of the recording apparatus.
Figure 9:
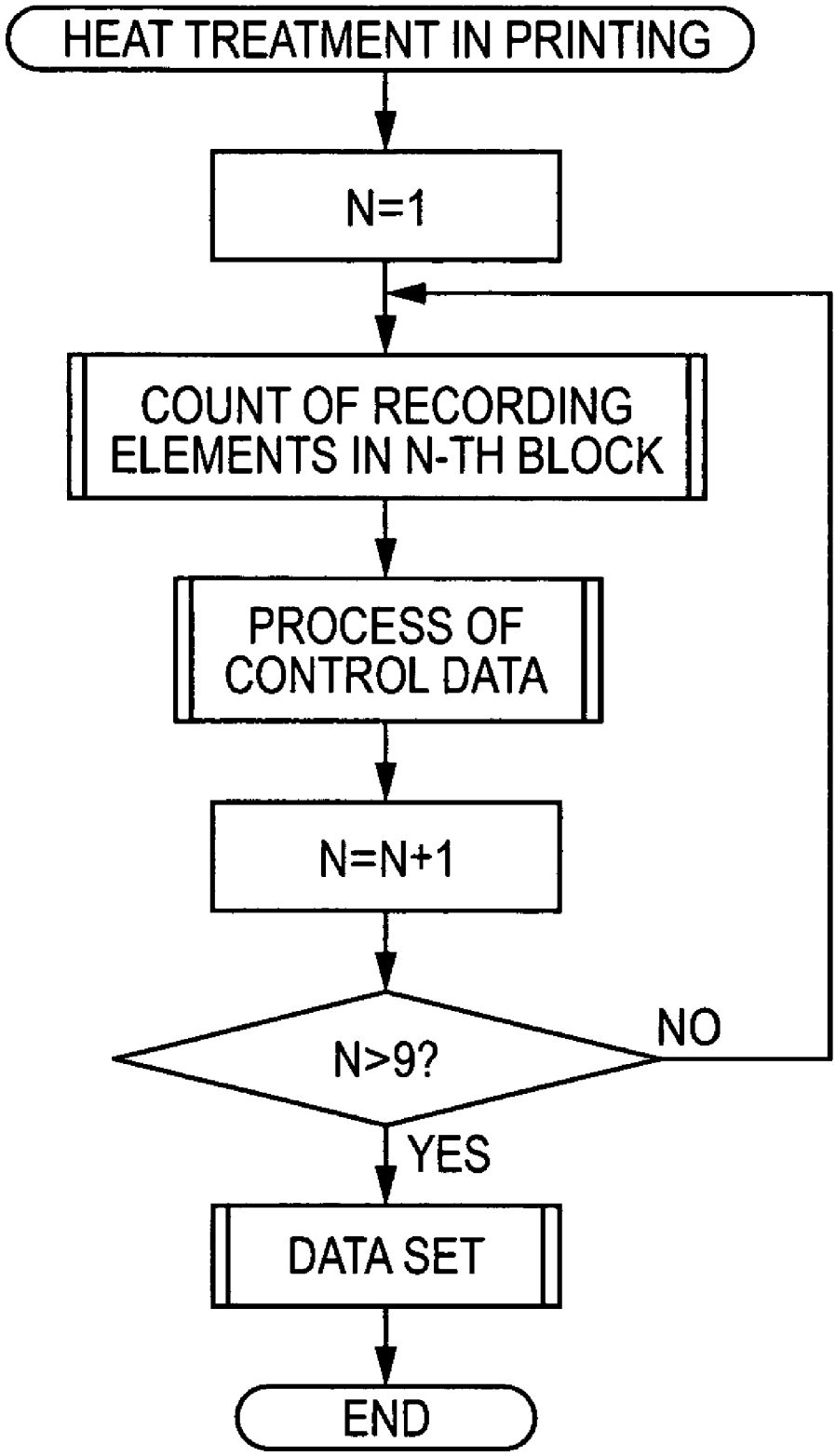
FIG. 9 is a flowchart of a basic preheat sequence in printing of the recording apparatus according to the embodiment of the present invention.

FIG. 7 is an example flowchart of a basic temperature control sequence of a recording apparatus according to the embodiment of the present invention. The surrounding temperature of the recording apparatus is sometimes lower than room temperature (about 25° C.) when power is turned on. In such a case, since a normal ink-discharge characteristic cannot be achieved, a preheat process is carried out. FIG. 8 is a flowchart of a basic preheat sequence of the recording apparatus, serving as a sub-routine of the temperature control sequence. First, the recording apparatus makes the temperature sensors function as temperature-detecting devices and determines whether the temperature of the inkjet recording head is close to its specified temperature (room temperature), lower than the room temperature, or abnormally high. If the temperature is close to room temperature, the normal treatment is achieved, and the sub-routine process ends (a normal response value is returned). If the temperature is abnormally high, the sub-routine process ends, and the treatment is regarded as abnormal (an abnormal response value is returned). Upon confirming the abnormal response value, the present sequence issues a head fault alarm, performs a head fault treatment, and ends the temperature control.

If the preheat treatment is normally carried out, a pre-discharge process is performed so that the recording head normally discharges ink from the initial stage of outputting a recording image. The pre-discharge treatment is conducted by driving all discharge nozzles of the recording head so as to improve the meniscus states of the discharge ports of the nozzles. By conduction, the preheat treatment performed after the pre-discharge treatment, and a determination is made whether the temperature of the recording head rises normally due to the pre-discharge treatment. The process moves to the foregoing fault treatment or a print standby state depending on the determination result. Upon receipt of a print start signal, computation information for driving the electrothermal converter row by an amount corresponding to M-lines is obtained from the information temporarily stored in a recording-image-information storing device in the recording apparatus.

A print duty for every time-division drive block is computed for every M-lines, and the computed result is reflected on the DATA signal. This heat process in printing is illustrated as a sub-routine of the foregoing sequence in FIG. 9.

In this heat process, variables are first initialized, and the number N of time-division blocks (in this case, eight) is defined. Pieces of on information of the electrothermal converters located in the respective sub-heater arrangement regions are counted, a computation for selecting a treatment among the treatments A to I shown in FIG. 6 is performed for each of all sub-heater arrangement regions according to the corresponding print duty (control information computation).

Upon completion of the entire process, bit information for determining an update timing of sub-heater energization in response to a LAT timing is set. Immediately after the above setting, the bit information is transmitted such that a drive timing of the recording head provided from the recording apparatus to the recording head. The heat treatment in printing always starts back over at least a single line of recording image information and, upon transmitting the drive timing to the inkjet recording head, is carried out for further ahead of the foregoing line.

On the occasion of actual drive control for each line, in order to confirm the process of proper temperature control, determination about the head temperature during the temperature-determining period shown in FIG. 5 is made. The determination temperature is a specified value when the temperature of the recording head rises abnormally during the heat-treatment computing period (printing period). If determined as abnormal, the present sequence carries out the foregoing head fault treatment and ends the temperature control. If determined as normal, the heat treatment in printing and the head temperature determination are repeated up to the M-th line where all recording image information has been processed. The temperature control sequence ends normally at the same time when a drive timing for the printing period of the M-lines is completely transmitted from the recording apparatus.

As described above, according to the present embodiment of the present invention, an advantage of compensating for a change in the recording element characteristic due to a fine temperature change of the recording head substrate is obtained. By arranging a plurality of the sub-heaters in a unit of a block of the electrothermal converters, accurate temperature control according to a print duty of each sub-heater arrangement region is achieved. With such a structure too, control information for individually controlling the plurality of sub-heaters is used for individually and selectively driving the recording elements built in the element substrate and is also inputted into a logic circuit section capable of achieving block selection drive, together with information to be inputted into the same. Hence the number of terminals of the recording head does not increase, thereby providing an advantage of reducing the cost of the recording head.

The recording information for individually controlling the heating devices is updated if necessary, while referring to temperature information detected by the temperature sensors disposed on the element substrate and recording image information of the recording head. Hence, even when the number of recording elements further increases so as to achieve a higher-definition recording image, the recording apparatus is available with an optimal recording element characteristic.

While the number of time-division drives tends to increase as the number of the recording elements increases, the present embodiment of the present invention offers a measure for solving a problem of an increase in the heating devices for adjusting a fine temperature change in each block.

While the recording apparatus has structure in which a sequence for individually controlling the heating devices is steadily supplied from its controller to the recording head, the present invention is applicable to the recording head having any pattern of wiring lines formed on the element substrate. As described in the embodiment, the recording apparatus has a structure in which the time-division drive circuit such as a decoder and the logic circuit such as a shift register circuit are built in the element substrate and in which the recording elements are individually driven by the electrodes allowing selective energization and a matrix of wiring lines allowing a time-division drive. Even with such a structure, the above-described advantage can be expected.

The structure of the present invention is important for forming an element substrate for a high-function and high-definition color inkjet recording head and, in particular, performs its advantage to the fullest extent when the number of the electrothermal converters increases. Since the number of the electrothermal converters has recently been increasing year by year, a reduction in cost of the inkjet-recording-head element substrate is essential.

One skilled in the art will appreciate that the present invention does not depend on the electrical and respective mechanical structures, software sequences, and so forth of the head and the apparatus.

While the inkjet type recording apparatus having a structure in which a bubble is generated so as to discharge ink by applying recording current on each recording element has been described in the foregoing embodiments, the present invention is applicable to other types of recording apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-375469 filed Dec. 27, 2004, which is hereby incorporated by reference herein in its entirety.

What is claimed is:

1. A recording-head element substrate having a plurality of electrothermal converters arranged thereon in a row pattern, comprising:

at least one element controlling application of electric current on the plurality of electrothermal converters;

at least one common electrode energizing the plurality of electrothermal converters;

at least one logic circuit selectively driving the plurality of electrothermal converters;

a plurality of temperature-adjusting heating devices, the plurality of temperature-adjusting heating devices being different from the plurality of electrothermal converters; and at least one heat-controlling circuit individually controlling the plurality of temperature-adjusting heating devices, wherein control information for individually controlling the plurality of temperature-adjusting heating devices by the heat-controlling circuit is externally received via an input terminal and image information inputted to the logic circuit for selectively driving the electrothermal converters or information for controlling a time-division-drive of the row of the electrothermal converters is inputted via the same input terminal.

2. The recording-head element substrate according to claim 1, further comprising at least one temperature-detecting device, wherein the control information for individually controlling the plurality of temperature-adjusting heating devices is based on information obtained from the temperature-detecting device.

3. The recording-head element substrate according to claim 1, wherein the control information for individually controlling the plurality of temperature-adjusting heating devices is based on the image information inputted into the logic circuit for selectively driving the electrothermal converters.

4. The recording-head element substrate according to claim 1, wherein the logic circuit and the heat-controlling circuit receive the image information and the control information as serial data.

5. The recording-head element substrate according to claim 1, wherein the control information individually specifies on/off of each of the plurality of temperature-adjusting heating devices.

6. The recording-head element substrate according to claim 1, wherein the logic circuit includes a shift register and latch, and a decoder.

7. The recording-head element substrate according to claim 1, wherein control information for individually controlling the plurality of heating devices is updated on the basis of at least one of an environmental temperature, a distribution of recording image information of a recording head, and a result of a detected recording head temperature.

8. The recording-head element substrate according to claim 1, further comprising at least one shift register serially receiving the control information and the image information via a mutual signal line.

9. The recording-head element substrate according to claim 8, wherein the shift register receives a signal for performing a time-division drive via the same signal line.

10. An inkjet recording head, comprising:

a recording-head element substrate including at least one element controlling application of electric current on a plurality of electrothermal converters, at least one common electrode energizing the plurality of electrothermal converters, at least one logic circuit selectively driving the plurality of electrothermal converters, a plurality of temperature-adjusting heating devices, the plurality of temperature-adjusting heating devices being different from the plurality of electrothermal converters, and at least one heat-controlling circuit individually controlling the plurality of temperature-adjusting heating devices, wherein control information for individually controlling the plurality of temperature-adjusting heating devices by the heat-controlling circuit is externally received via an input terminal and image information inputted to the logic circuit for selectively driving the electrothermal converters or information for controlling a time-division-drive of the row of the electrothermal converters is inputted via the same input terminal; and a plurality of ink discharge ports arranged so as to correspond to the plurality of electrothermal converters and to discharge ink by driving corresponding recording heads.

11. A recording apparatus having an inkjet recording head mounted thereon, comprising:

a recording head including at least one element controlling application of electric current on a plurality of electrothermal converters, at least one common electrode energizing the plurality of electrothermal converters, at least one logic circuit selectively driving the plurality of electrothermal converters, a plurality of temperature-adjusting heating devices, the plurality of temperature-adjusting heating devices being different from the plurality of electrothermal converters; and at least one heat-controlling circuit individually controlling the plurality of temperature-adjusting heating devices, wherein control information for individually controlling the plurality of temperature-adjusting heating devices by the heat-controlling circuit is externally received via an input terminal and image information inputted to the logic circuit for selectively driving the electrothermal converters or information for controlling a time-division-drive of the row of the electrothermal converters is inputted via the same input terminal; and a circuit outputting the control information to the recording head.

* * * * *